United States Patent [19]

Mansfield

[11] Patent Number: 5,054,771

[45] Date of Patent: Oct. 8, 1991

[54] COMPUTER-INTERACTIVE GAME MACHINE WITH SWING-ACTION

[75] Inventor: Michael R. Mansfield, Lee County, Fla.

[73] Assignee: Outer Sports, Inc., Fort Myers, Fla.

[21] Appl. No.: 381,107

[22] Filed: Jul. 17, 1989

[51] Int. Cl.[5] ..... A63B 69/16

[52] U.S. Cl. ..... 272/73; 272/85; 272/130; 272/DIG. 5; 434/247; 434/392; 128/25 R; 273/85 G; 273/438; 73/379

[58] Field of Search ..... 272/85, 86, 92, 73, 272/129, 132, 96, 117, 134, 146, DIG. 5, 130; 73/379; 434/247, 258, 392, 43, 57; 273/1 GE, 1 E, DIG. 28, 85 G, 148 B; 128/25 R, 25 B

[56] References Cited

U.S. PATENT DOCUMENTS

| | | | |
|---|---|---|---|
| 4,461,470 | 7/1984 | Astroth et al. | 434/57 X |
| 4,478,407 | 10/1984 | Manabe | 434/43 X |
| 4,556,216 | 12/1985 | Pitkanen | 272/134 X |
| 4,630,817 | 12/1986 | Buckley | 272/73 |
| 4,711,447 | 12/1987 | Mansfield | 272/73 |
| 4,817,950 | 4/1989 | Goo | 272/146 X |

*Primary Examiner*—Richard J. Apley
*Assistant Examiner*—Joe H. Cheng
*Attorney, Agent, or Firm*—William E. Noonan

[57] ABSTRACT

In this invention, a computer-interactive swingable member with a seat thereon is suspended from a swing-support member and swingable in a vertical arc by leg-and-feet muscle power with the feet of an individual sitting on the seat engaged in stirrups positioned in front of the swingable member. The swingable member is horizontally pivotal on an extension from a base member by arm-and-hand muscle power with the hands grasping joystick handlebars. A marker on a computer monitor is computer-interactively engaged with the movement of the seat such that swinging motion of the seat causes the marker to travel selectively up-and-down and side-to-side rotation of the seat causes the marker to travel selectively from-side-to-side on a computer monitor. Resistance to swinging and side-to-side motion can be provided selectively for exercise and the computer can be programmable for selected game and design computer software.

15 Claims, 3 Drawing Sheets

COMPUTER-INTERACTIVE GAME MACHINE WITH SWING-ACTION

BACKGROUND OF THE INVENTION

1. Field of the Invention.

This invention combines exercise machines and video game machines with a type of game machine which can be coordinated with conventional video games in optionally and selectively variable programmable game-playing exercise. More particularly, it provides a game machine with totally muscle-powered swinging action from leg power and rotating action from arm power that is computer-interactive with computer games and computer-aided drafting machines.

2. Description of Related Art.

Video games are notoriously lacking in exercise but fascinating with interest of initiated devotees. Exercising is equally notorious for boredom from monotonous routine. This invention combines video-game-playing excitement and interest with physical activity that can be more exciting than game-playing either without physical exercise or optionally with physical exercise that can be scientifically programmable for maximized benefit to the body. It utilizes the best of both worlds.

This invention differs from the applicant's prior U.S. Pat. No. 4,711,477 and this applicant's improvement modification of that patent U.S. patent application Ser. No. 354,233, filed May 19, 1990; in this present application does not employ pedaling action with the feet to achieve movement of a machine seat and movement of a marker on a computer-game monitor. Further, the mechanism of this invention achieves vertically-swingable action of a seat on a machine and up-and-down travel of a marker on a computer-game monitor, rather than horizontally-rotatable action and side-to-side travel of a marker on a computer-game monitor, with the legs and feet and muscles related thereto. Further in addition, the mechanism of this invention is constructed to achieve horizontally-rotational action of a seat on a machine and side-to-side travel of a marker on a computer-game monitor, rather than vertically pivotal action of a seat on a machine and up-and-down travel of a marker on a computer-game monitor, with the arms and hands and muscles related thereto.

Previously, there have been exercise machines in combination with video games but not with the working relationship of parts and advantages of this invention. Two other prior U.S. patents, U.S. Pat. Nos. 4,461,470 and 4,478,407, employ a video unit in combination with physical activity of a player. But they do not provide exercise and their physical activity is different with different types of mechanisms for achieving it. The physical activity provided by this invention and the above prior inventions by this Applicant add not only game-playaing excitement but also psychological exercise in physical coordination.

A U.S. patent that does provide physical exercise in relationship to video games is U.S. Pat. No. 4,630,817. However, instead of experiencing the up-and-down climbing and diving and the side-to-side directional changing of vehicle-movement simulation with actual body movement provided by this invention or by the above prior art, the exercising game-player in that device remained stationary while only their feet and hands moved.

SUMMARY OF THE INVENTION

In this invention, a computer-interactive swingable member with a seat thereon is suspended from a swing-support member and swingable in a vertical arc by leg-and-feet muscle power with the feet of an individual sitting on the seat engaged in stirrups positioned in front of the swingable member. The swingable member is horizontally pivotal on an extension from a base member by arm-and-hand muscle power with the hands grasping joystick handlebars. A marker on a computer monitor is computer-interactively engaged with the movement of the seat such that swinging motion of the seat causes the marker to travel selectively up-and-down and side-to-side rotation of the seat causes the marker to travel selectively from-side-to-side on a computer monitor. Resistance to swinging and side-to-side motion can be provided selectively for exercise and the computer can be programmable for selected game and design computer software.

DESCRIPTION OF DRAWINGS

This invention is described in claims and in a description of preferred embodiments in relation to the following drawings wherein:

Referring to FIGS. 1 and 3, alternatively, the handlebars 12 can be attachable to the monitor rod 11 and extendable downwardly from below the monitor 10 on a monitor handlebar rod 14. The handlebars 12 can be any desired shape such as the straight form illustrated in FIG. 1 or yoke handlebars 15 illustrated in FIG. 3. When handlebars 12 or 15 are attached to monitor handlebar rod 14, side-to-side rotational travel of the swing member 1 and the swing seat 9 can be achieved through a hydraulic means shown in FIG. 3. For the hydraulic means, a hydraulic-piston actuator member 16 can be extendable from the monitor handlebar rod 14 to a position between left hydraulic piston 17 and opposing right hydraulic piston 18 in respective left cylinder 19 and right cylinder 20. Rotation of the handlebars causes hydraulic fluid in the cylinders to flow through respective left hydraulic line 21 and right hydraulic line 22 to double-ended hydraulic cylinder 23 with double-ended hydraulic piston 24. A rack-and-pinion gear 25 can be employed to actuate the horizontal section of the swing support member 6 to which the rack-and-pinion gear 25 can be attached to cause rotational motion in relationship to base-member rotation rod 5. Typical options in the construction of the hydraulic means are that the lines 21 and 22 can be flexible or they can be non-flexible with flexible sections at swinging pivot joints 26 and rotational pivot joints 27 as appropriate. Also the hydraulic-piston actuator member 16 can be a rack-and-pinion gear. Other methods of achieving rotational travel through the monitor handlebar rod could be electrical or mechanical linkage. Other hydraulic means also could be employed. This means is illustrated only to demonstrate feasibility of an alternative to the base-handlebar feature of this invention.

Referring to FIG. 2, the swing member 1 with swing seat 9 is suspended from swing cross-rod 28 which is attached to rotational swing rod 29 in pivotal engagement with stationary swing support member 30. The stationary swing support member 30 is extended from a vertical swing support member 31 which is attached to a base member 4 below the swing member 1 or to alternative wall or base members. The base member illustrated in FIG. 1 also can be attached to rotatable swing-support wall base member 33 as an option to floor mounting. For either type of swing support, there can be multiple wall-base members as appropriate for particular use-conditions. Handlebar members 34 can be attachable on or in the stationary swing support member. A stirrup rod 8 having stirrups 7 thereon is attachable rigidly to the rotational swing rod 29 and monitor rods 11 (shown partly in phantom for clarity) for supporting a monitor 10 are attached rigidly to swing members 1. Thus, the same swinging and rotational action as achievable with the FIG. 1 embodiment can be achieved with the FIG. 2 embodiment.

Referring to FIG. 4, a fundamental feature of this invention is computer-interaction between a computer program illustrated on a computer monitor 10 with an individual in seat 9. There are a wide selection of known electrical connections between computers and interfacing actuators. In light of the prior-art descriptions in relation to such technology, particularly as described in the applicant's prior U.S. Pat. No. 4,711,477 and in referenced prior U.S. Pat. Nos. 4,461,470 and 4,478,407, only the working relationship of parts are illustrated. From computer with monitor 10, electrical lines 35 are shown in relation to opposite-directional electrical lines 36 with swinging-position indicator 37, rotational-position indicator 38 and trigger unit 39. It is assumed that well-known technology can be applied in relation to these components in the working relationship of parts described and taught by this invention. Included also is the utilization of computer-aided drafting and other computer-aided design, art and work such that creative activities and expressions can be achieved in computer-interactive relationship to dynamic bodily movement and action of bodily members.

Referring to FIG. 5, the swing member 1 is shown in pivotal relationship to cross-rod 28 attached to rotational swing rod 29 in pivotal relationship to stationary swing support member 30. Also illustrated from a sectional side view are monitor base rod 11 rigidly attached to the swing member 1 and stirrup rod 8 rigidly attached to rotational swing rod 29.

Referring to FIG. 6, an optional ball-and-socket means of suspension from stationary swing support member 30 is shown with ball member 40 attached to pivotal ball rod 41. Monitor rod 11 is attachable rigidly to swing member 1 while stirrup rod 8 is attachable rigidly to ball rod 41.

Figure 1:
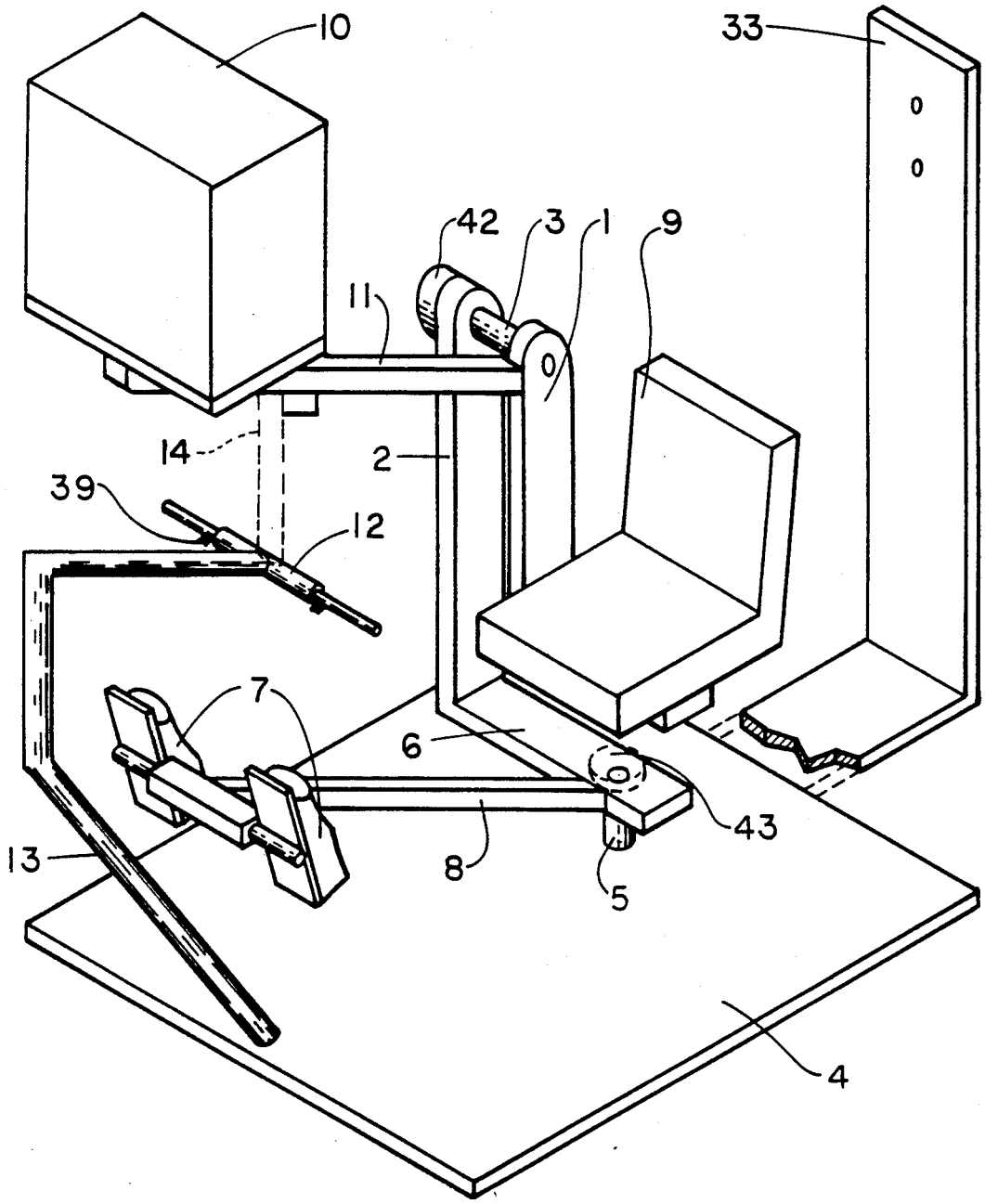
FIG. 1 is cutaway perspective view of an embodiment of the invention with bottom rotational pivot means.

Referring to all FIGS. 1–6, another fundamental feature of this invention is optional and selective utilization of resistance to either or both rotational and swinging travel for purposes of achieving exercise. The workload of exercise resistance can be either constant or variably programmed for selectively different resistance levels throughout positive and negative muscle cycles. Programmable variation in resistance also is known prior art but not in the working relationship of parts that comprise this invention. The functions of such features, rather than description of the features, therefore, are described in working relationship to this invention. Pivotal resistance and indicator functions occur at the same locations and are closely related. Consequently, pivotal resistance and indicator functional units are shown as the same unit in the same place generally in the working relationship of parts of this invention. A swinging resistance and indicator unit 42 is illustrated in the FIG. 1 emobodiment at the point of swinging movement on the swing support member 2. Also in FIG. 1, a rotational resistance and indicator unit 43 is shown at the rotational contact of the horizontal section of swing support member 6 with the rotation rod 5 on the base member 4.

Figure 3:
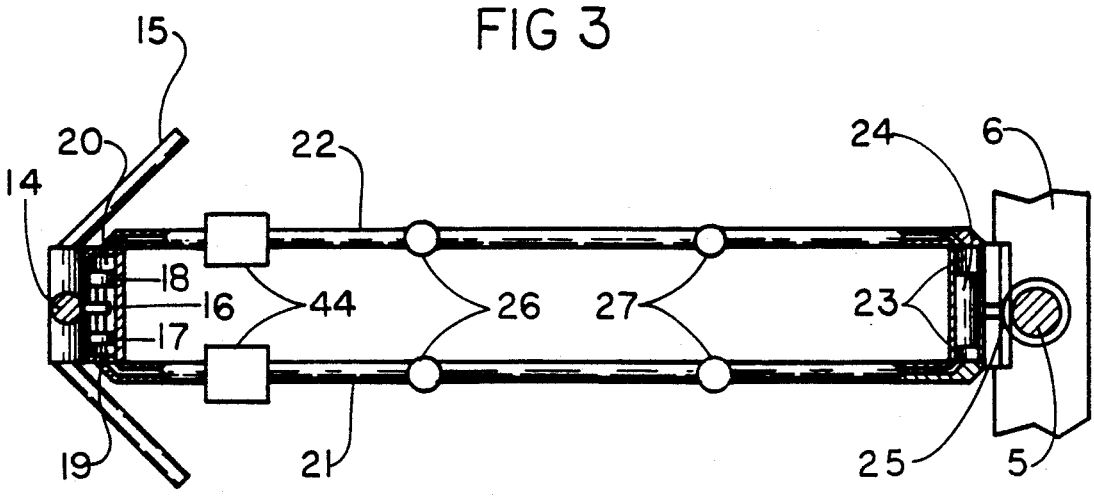
FIG. 3 is a cutaway fluid-flow schematic view of an optional rotational means for the FIG. 1 embodiment.

Referring to FIGS. 1 and 3, rotational resistance can be employed in the hydraulic lines 21 and 22 as shown by hydraulic-resistance-and-indicator unit 44.

Figure 2:
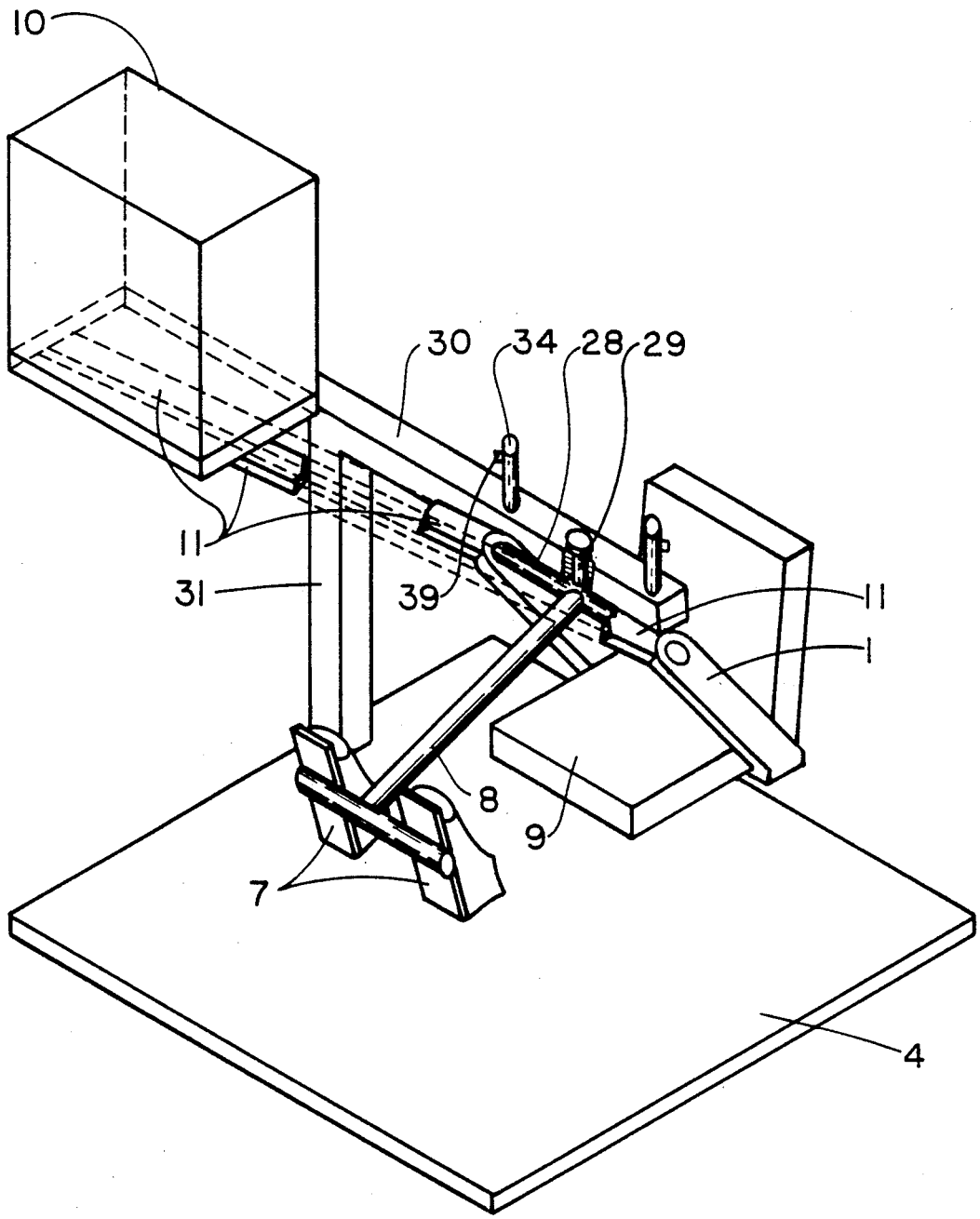
FIG. 2 is a cutaway perspective view of an embodiment of the invention with top ratational pivot means.
Figure 5:
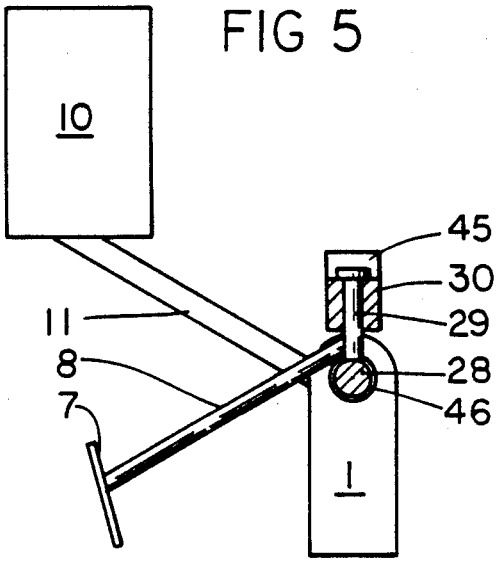
FIG. 5 is a sectional cutaway view of an optional rotatable cross-rod swing means for the FIG. 2 embodiment.
Figure 6:
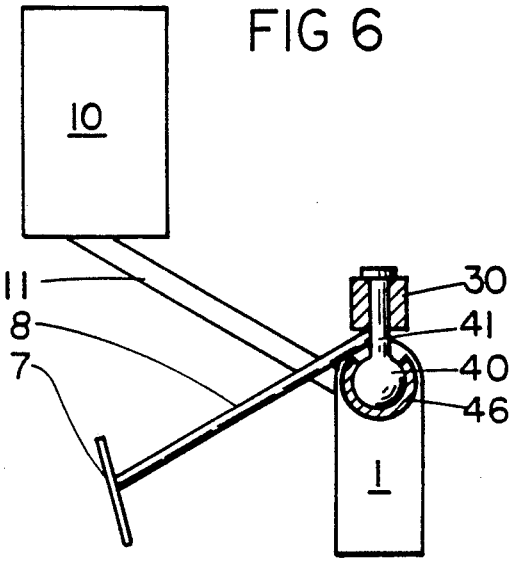
FIG. 6 is a sectional cutaway view of an optional ball-and-socket swing-and-rotation means for the FIG. 2 embodiment. cl DESCRIPTION OF PREFERRED EMBODIMENTS Referring to FIG. 1, a swing member 1 is pivotally attached to a vertical portion of a swing support member 2 by means of a swing rod 3. The swing support member 2 is pivotally attached to base member 4 by means of rotation rod 5 at a horizontal section 6 of the swing support member 2. Feet stirrups 7 are attached to stirrup rod 8 which is extendable in rigid contact from swing-support horizontal section 6 such that an individual sitting on seat 9 on swing member 1 can achieve vertically swinging motion of the swing seat 9 and the swing member 1 by push-and-pull leg-and-feet muscle action exerted between the swing seat 9 and the stirrups 7. A computer monitor 10 is positionable on a monitor rod 11 that is extendable rigidly from swing support member 2 such that swinging action of the swing support member 2 causes the computer monitor 10 to travel in an arc that is constant and thereby provides constant vision in relation to the swing seat 9. Joystick handlebars 12 are attachable to base handlebar rod 13 which is rigidly attachable to the base member 4 in front of the swing seat 9 such that side-to-side horizontally rotational motion can be achieved simultaneously with vertically swinging motion of the swing seat 9 by arm-and-hand muscle action simultaneously with leg-and-feet muscle action selectively by an individual in seat 9. The monitor remains constantly in front of the individual in seat 9 for both vertically swinging and horizontally rotating travel of the swing seat.

Referring to FIGS. 2, 5 and 6, rotational resistance and indicator units 45 can be applied at points of contact between the rotational swing rod 29 and the stationary swing support member 30. Swinging resistance and indicator units 46 can be applied at points of contact between the swing cross-rod 28 and the swing members 1.

Figure 4:
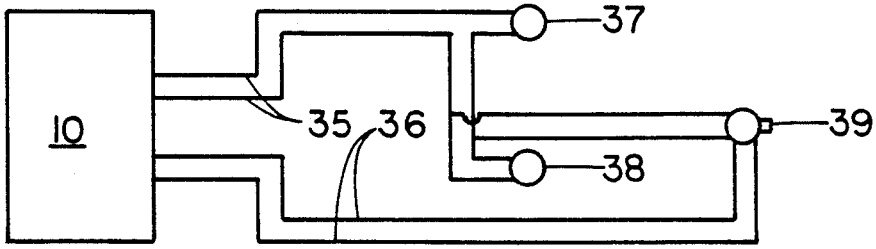
FIG. 4 is a schematic view of an electrical circuit for the invention.

Schematically, electrical computer-interactive and mechanical working relationship of parts are illustrated in FIG. 4 as described above.

What is claimed is:

1. A computer interactive game machine having a video monitor interconnected with said machine, such that said video monitor is generally visible to a user of said machine, said machine comprising:

a support structure;

a swing apparatus including a seat and means for swingably mounting said seat to said support structure, said means for swingably mounting including first pivot means from which said seat is suspended and second pivot means interconnected between said support structure and said first pivot means, said first pivot means being pivotable about a first axis and said second pivot means being pivotable about a second axis, which is transverse to said first axis;

engagement means mounted to said support structure generally in front of said seat and being engagable by an operator seated in said seat for pivoting said seat in selected directions about said first and second axes; and position sensing means interconnected between said swing apparatus and the video monitor and being responsive to movement of said seat about said first and second axes for generating a signal representative of the position of said seat.

2. The machine of claim 1 in which said engagement means include handlebar means, which are engagable by the operator's hands for pivoting said seat about at least one of said axes.

3. The machine of claim 2 in which said handlebar means are fixed to said support structure.

4. The machine of claim 2 further including hydraulic means operably interconnecting said handlebar means and said means for swingably mounting for assisting pivoting of said seat about at least one of said axes.

5. The machine of claim 2 in which said handlebar means include trigger means interconnected with the video monitor for selectively providing interactive signals thereto.

6. The machine of claim 1 in which said engagement means include pedal means, which are engagable by the operator's feet for pivoting said seat about at least one of said axes.

7. The machine of claim 6 in which said pedal means are connected to said support structure through said means for swingably mounting.

8. The machine of claim 1 in which said swing apparatus further includes means fixedly attached to said swing seat for supporting said video monitor generally in front of said seat.

9. The machine of claim 1 in which said support structure includes a platform portion.

10. The machine of claim 9 in which said support structure further includes at least one support arm fixed to and extending above said platform.

11. The machine of claim 1 in which said first pivot means have a generally horizontal axis and said second pivot means have a generally vertical axis.

12. The machine of claim 1 in which said means for swingably mounting further include a first mounting section, which is connected to said support structure by said first pivot means and a second mounting section which carries said seat and is connected to said first mounting section by said second pivot means.

13. The machine of claim 12 in which said engagement means include pedal means fixedly attached to and supported outwardly from said first mounting section for engagement with the operator's feet.

14. A computer interactive game machine comprising:

a support structure;

a swing apparatus including a seat, means for swingably mounting said seat to said support structure, said means for swingably mounting including first pivot means from which said seat is suspended and second pivot means interconnected between said support structure and said first pivot means, said first pivot means being pivotable about a first axis and said second pivot means being pivotable about a second axis, which is transverse to said first axis, and means fixedly attached to said seat for supporting a video monitor generally in front of said seat;

engagement means mounted to said support structure generally in front of said seat and being engagable by an operator seated in said seat for pivoting said seat in selected directions about said first and second axis; and position sensing means interconnected between said swing apparatus and said video monitor and being responsive to movement of said seat about said first and second axes for generating a signal representative of the position of said seat, said monitor being responsive to said signal for generating a display which is representative of the position of said seat.

15. A computer interactive game machine having a video monitor interconnected with said machine, such that said video monitor is generally visible a to an user of said machine, said machine comprising:

a support structure;

a swing apparatus including a seat and means for swingably mounting said seat to said support structure, said means for swingably mounting including first pivot means disposed above said seat and from which said seat is suspended and second pivot means interconnected between said support structure and said first pivot means, said first pivot means being pivotable about a first axis and said second pivot means being pivotable about a second axis, which is transverse to said first axis;

engagement means mounted to said support structure generally in front of said seat and being engagable by an operator seated in said seat for pivoting said seat in selected directions about said first and second axes; and position sensing means interconnected between said swing apparatus and the video and being responsive to movement of said seat about said first and second axes for generating a signal representative of the position of said seat.

* * * * *